United States Patent [19]

Qquantz

[11] Patent Number: 4,960,033

[45] Date of Patent: Oct. 2, 1990

[54] GUN FIRING RELAY CIRCUIT

[75] Inventor: Chester C. Quantz, Valley Hills, Tex.

[73] Assignee: Electro-Tech, Inc., Westland, Mich.

[21] Appl. No.: 290,164

[22] Filed: Dec. 27, 1988

[51] Int. Cl.[5] ..... F41A 19/60

[52] U.S. Cl. ..... 89/28.05; 89/135

[58] Field of Search ..... 89/28.05, 28.1, 135

[56] References Cited

U.S. PATENT DOCUMENTS

| | | | |
|---|---|---|---|
| 3,451,307 | 6/1969 | Grundberg | 89/135 |
| 3,736,837 | 6/1973 | Kaprelian et al. | 89/28.05 |
| 3,888,157 | 6/1975 | Vorgrimler et al. | 89/1.4 |
| 3,967,530 | 7/1976 | Vorgrimler et al. | 89/135 |
| 3,967,557 | 7/1976 | Irish, Jr. | 102/216 |
| 3,982,347 | 9/1976 | Brandl et al. | 42/84 |
| 4,009,536 | 3/1977 | Wolff | 89/135 |
| 4,320,704 | 3/1982 | Gawlick et al. | 102/209 |
| 4,440,063 | 4/1984 | Zangrando | 89/135 |
| 4,686,886 | 8/1987 | Caserza et al. | 89/11 |
| 4,709,615 | 12/1987 | Field | 89/28.05 |
| 4,727,670 | 3/1988 | Krouse | 89/28.1 |

FOREIGN PATENT DOCUMENTS

| | | | |
|---|---|---|---|
| 2139418 | 3/1973 | Fed. Rep. of Germany | 89/135 |
| 2703803 | 8/1978 | Fed. Rep. of Germany | 89/28.05 |

*Primary Examiner*—Charles T. Jordan
*Assistant Examiner*—Stephen Johnson
*Attorney, Agent, or Firm*—Krass & Young

[57] ABSTRACT

The invention is an electronic circuit with several inputs, several outputs, a timing circuit, and two switching circuits used to actuate the firing of certain firearms. The circuit is partitioned into a voltage boosting circuit, a machine gun firing circuit and a cannon firing circuit. The voltage boosting circuit produces a voltage that is larger than the supply voltage, which is used to facilitate the operation of MOSFET switching circuits. The machine gun firing circuit connects a low impedance voltage source to a particular output only so long as a particular input is electrically asserted. The cannon firing circuit connects a low impedance voltage source to a particular output for a specified period of time only in response to a stimulus on one particular input and only if an additional arming input is electrically asserted.

17 Claims, 2 Drawing Sheets

GUN FIRING RELAY CIRCUIT

FIELD OF THE INVENTION

This invention relates to simple electronic circuits used to effect the firing of firearms using either ammunition detonated directly by an signal or ammunition detonated by the concussion produced by an electrically actuated device.

BACKGROUND OF THE INVENTION

Certain fixed ammunition is detonated by passing a current through an ignition device. It is desirable that the duration of such a current be limited to a period in the neighborhood of 300 mS. It is also desirable for a firing circuit to be readably able to actuate electrically actuated devices that are used to detonate ammunition with a concussion.

SUMMARY OF THE INVENTION

The invention comprises an electronic circuit with several inputs, several outputs, a timing circuit, and two switching circuits that may functionally be divided into a voltage boosting circuit, a machine gun firing circuit and a cannon firing circuit. The voltage boosting circuit produces a voltage that is larger than the supply voltage, which is used to facilitate the operation of the switching circuits. The machine gun firing circuit is so arranged as to connect a low impedance voltage source to a particular output only so long as a particular input is electrically asserted. The cannon firing circuit is so arranged as to connect a low impedance voltage source to a particular output for a specified period of time only in response to a stimulus on one particular input.

The invention is advantageous in that it performs its intended function reliably because of the relatively few simple components used, and, because of its particular arrangement of those components, its operation is insensitive to its physical and electrical environment.

A further advantage of the invention is the absence of the need to adjust component values during manufacture since important relationships are more dependent upon ratios of components or voltages than the sizes of components, and since non critical components can vary widely in their electrical characteristics without adverse effects.

BRIEF DESCRIPTION OF THE DRAWINGS

One will better understand the present invention by referring to the following detailed description while consulting the accompanying drawings, where the same reference numerals are used to refer to the same parts throughout, and in which.

DETAILED DESCRIPTION OF THE PREFERRED EMBODIMENT OF THE PRESENT INVENTION

Figure 1:
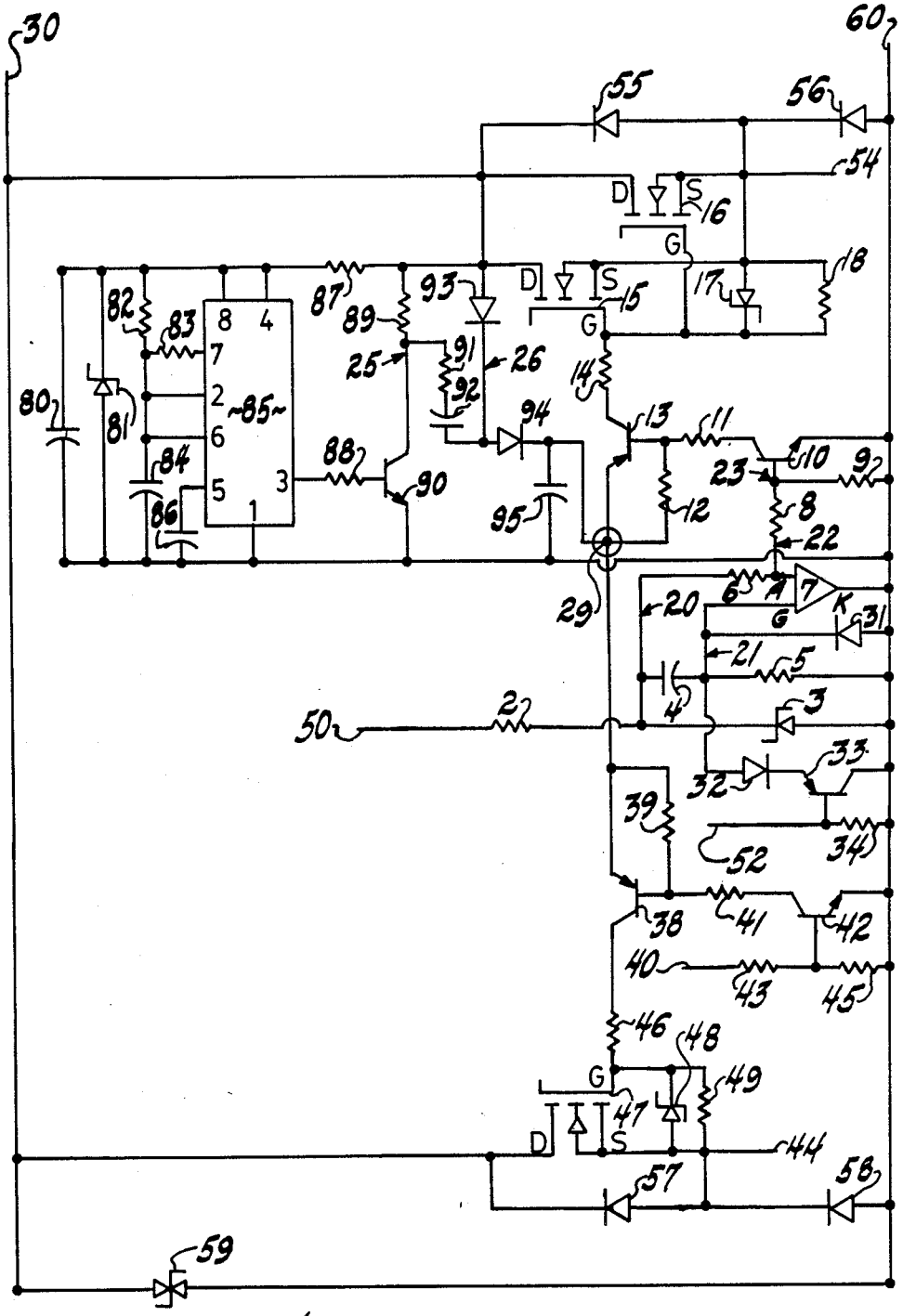
FIG. 1 is an electronic schematic of the preferred embodiment of the invention.

The invention's schematic, FIG. 1, may be divided into the voltage boosting circuit, the machine gun (MG) firing circuit, and the cannon firing circuit. All circuits utilize supply voltage input 30 and electrical common 60.

The voltage boosting circuit comprises an oscillator section and a rectifier section so arranged as to produce a voltage on boosted voltage buss 29 that is larger than the supply voltage and tracks the supply voltage. This voltage is needed for the satisfactory operation of the MOSFET switching circuits. Resistor 87, capacitor 80, and zener diode 81 form a smoothed and regulated voltage used to operate the oscillator comprising resistor 82, reistor 83, capacitor 84, oscillator IC 85, and capacitor 86. Oscillator IC 85 is the well known "555" device and is used in an oscillator circuit having on and off times determined by the associated components. Zener diode 81 serves to protect oscillator IC 85 from excessive voltage. The oscillator's output is connected to resistor 88 and the output signal is such as rapidly to turn on and off boosting circuit's transistor 90. As boosting circuit's transistor 90 turns on and off, the voltage on junction 25 oscillates between a little more than zero and a little less than supply voltage. When boosting circuit's transistor 90 turns on, the voltage on junction 25 is nearly equal to zero and capacitor 92 charges to somewhat less than the supply voltage through diode 93 and resistor 91. The polarities are such that the most positive terminal of capacitor 92 is connected to junction 26. When boosting circuit's transistor 90 turns off, the voltage on junction 25 becomes a little less than the supply voltage and this voltage adds to the voltage across capacitor 92 causing diode 94 to charge capacitor 95 to somewhat less than twice the supply voltage. The operation of this circuit may also be described as a sequence of events as follows (capacitors initally uncharged):

the first time boosting circuit's transistor 90 is turned on by the oscillator section, the voltage on junction 25 becomes nearly equal to zero and thus diode 93 turns on, charging capacitor 92 to somewhat less than the supply voltage with the most positive terminal connected to junction 26, and diode 94 also turns on, charging capacitor 95 to nearly the supply voltage;

when boosting circuit's transistor 90 subsequently turns off, the voltage on junction 25 beomes nearly equal to the supply voltage, the voltage on junction 26 becomes somewhat less than twice the supply voltage, diode 93 turns off, and diode 94 turns on, allowing capacitor 95 to charge to somewhat less than twice the supply voltage; and thereafer, when boosting circuit's transistor 90 turns on, only diode 93 will turn on allowing the charging of capacitor 92 to somewhat less than the supply voltage and when boosting circuit's transistor 90 turns off, only diode 94 will turn on allowing capacitor 95 to charge to somewhat less than twice than the supply voltage.

The machine gun firing circuit produces a firing signal on MG firing output 44 when an appropriate signal is applied to MG trigger input 40. In the preferred embodiment, a voltage of 18 to 30 volts applied to MG trigger input 40 causes sufficient current through resistor 43 and resistor 45 to turn on NPN transistor 42. The turned on NPN transistor 42 passes current from boosted voltage buss 29 through resistor 39 and resistor 41 causing PNP transistor 38 to turn on and connect boosted voltage buss 29 through resistor 46 to the gate of N-channel MOSFET 47, turning it on. N-channel MOSFET 47 has supply voltage input 30 connected to its drain and MG firing output 44 connected to its source, thus, when is turned on, supply voltage input 30 is effectively connected to MG firing output 44. An external mechanism, connected to MG firing output 44, responds to the voltage by firing the machine gun. MG firing output 44 will be connected to supply voltage input 30 while, and only while, MG trigger input 40 is supplied with sufficient voltage.

The cannon firing circuit produces one fixed length supply voltage pulse to cannon firing output 54 for each assertion of cannon trigger input 50 while the circuit is armed by asserting cannon arming point 52. In the preferred embodiment, assertion is a voltage between about 18 and 30 volts, and the firing pulse appearing on cannon firing output 54 is about 300 mS long. Regardless of any other signals, cannon firing output 54 will never be asserted unless cannon arming input 52 is asserted. In essence, shortly after both cannon arming input 52 and cannon trigger input 50 are asserted, parallel N-channel MOSFETs 15 and 16 are turned on asserting cannon firing output 54 and about 300 mS later programmable unijunction transistor 7 changes state causing parallel N-channel MOSFETs 15 and 16 to become off and cannon firing output 54 to deassert. The cannon firing circuit will be described in detail: first assuming cannon arming input 52 is asserted and then assuming cannon arming input 52 is not asserted.

When cannon arming input 52 is asserted, PNP transistor 33 will always be off because of the resulting large positive voltage on its base, thus no current can pass through diode 32 and PNP transistor 33 and these components, used to prevent the assertion of cannon firing output 54 when cannon arming input 52 is not asserted (as explained below), may be ignored. As soon as cannon trigger input 50 is asserted, sufficient current will exist in the branch including resistor 2, resistor 6, resistor 8, and the base emitter junction of NPN transistor 10 to turn NPN transistor 10 on. This is due, in part, to programmable unijunction transistor 7 being off because its gate voltage will initially be more positive than its anode voltage. With NPN transistor 10 on, charge will flow from boosted voltage buss 29 through resistor 12, resistor 11 and NPN transistor 10 turning on PNP transistor 13. With PNP transistor 13 turned on, the voltage on boosted voltage buss 29 will be applied to the gates of parallel N-channel MOSFETs 15 and 16 causing them to turn on and apply the voltage on the supply voltage input 30, connected to the drains, to cannon firing output 54, connected to the sources. This condition will continue for a short period of time thereafter, as explained in the following.

As described above, with cannon arming input 52 asserted, very soon after cannon trigger input 50 is asserted both NPN transistor 10 and PNP transistor 13 will be turned on, and thus cannon firing output 54 will be asserted. At the time cannon trigger input 50 is asserted, capacitor 4 will be essentially discharged and its voltage will be essentially zero. Thus the gate of programmable unijunction transistor 7 will be more positive than the anode and programmable unijunction transistor 7 will be non conductive. Because capacitor 4 and resistor 5 are in parallel with zener diode 3, which together with resistor 2 forms a voltage regulator, the initially uncharged capacitor 4 will be charged at an exponential rate by current through resistor 5 and the capacitor's voltage will approach that of zener diode 3. Eventually, the gate of programmable unijunction transistor 7, connected to the junction between capacitor 4 and resistor 5, will be less positive than its anode, and programmable unijunction transistor 7 will become highly conductive from anode to cathode with a voltage drop less than the approximately 0.65 volts needed to keep the base-emitter junction of NPN transistor 10 on. Stated a different way, as the capacitor charges, the gate voltage of programmable unijunction transistor 7 approaches that of the cathode and, when the gate voltage becomes a bit less positive than the fixed voltage on the anode of programmable unijunction transistor 7, the programmable unijunction transistor 7 shunts the current that would have been used to keep NPN transistor 10 on. This, in turn, causes PNP transistor 13 to turn off and parallel N-channel MOSFETs 15 and 16 to turn off, thus deasserting cannon firing output 54. The product of the capacitance of capacitor 4 and the resistance of resistor 5 is picked so as to make the firing of programmable unijunction transitor 7 occur about 300 mS after cannon trigger input 50 is asserted.

The operation of the timer portion of the cannon firing circuit may also be described in more detail by making reference to the junction voltages. Since the entire circuit uses electrical common 60 as its common junction, electrical common 60 shall be used as the voltage reference (0 v) in the following description. It is also assumed that each forward biased junction (such as a base emitter junction of a transistor that is on) has a nominal 0.65 volts across it. In the preferred embodiment, the nominal breakdown voltage of zener diode 3 is 8.2 volts, a voltage selected to be significantly smaller than the minimum expected power supply voltage. Thus, when cannon trigger input 50 is asserted, four major events occur: (1) a voltage-current path is supplied to the emitter of NPN transistor 10 through resistors 12 and 11; (2) the voltage at junction 20 becomes nominally 8.2 volts, and will stay at that voltage while cannon trigger input 50 is asserted because zener diode 3 is placed in breakdown; (3) the 8.2 volts on junction 20 insures that the base-emitter junction of NPN transistor 10 is forward biased through resistor 6 and resistor 8, thus the voltage at junction 23 will be about 0.65 volts, and the voltage at junction 22, since programmable unijunction transistor 7 is non-conducting, will be a fixed voltage between 0.65 and 8.2 that is determined by the ratio of the size of resistor 6 to resistor 8 (in the preferred embodiment, the voltage on junction 22 is about 3.2 volts); and (4) since capacitor 4 is initially discharged, its voltage is zero and thus the voltage on junction 21 is 8.2 volts and the voltage decreases exponentially towards zero as capacitor 4 charges. Therefore, in the preferred embodiment, when cannon trigger input 50 is asserted while cannon arming input 52 is asserted, parallel N-channel MOSFETs 15 and 16 turn on asserting cannon firing output 54, the voltage on the anode of programmable unijunction transistor 7 (junction 22) is about 3.2 volts, and the voltage on the gate of programmable unijunction transistor 7 (junction 21) is initially 8.2 volts and is decreasing at an exponential rate determined by the time constant of capacitor 4 and resistor 5. Because of the placement of zener diode 3 between junction 20 and electrical common 60, all of the critical voltages and time periods are virtually independent of the actual power supply voltage. In the preferred embodiment, about 300 mS after cannon trigger input 50 is asserted, the voltage on junction 21 will have decreased to a value somewhat less than the voltage on junction 22. That is to say, the gate voltage of programmable unijunction transistor 7 will become less positive than the anode voltage of programmable unijunction transistor 7 and programmable unijunction transistor 7 will become highly conductive from anode to cathode. This causes the voltage on junction 22 to become very small, too small to maintain node 23 at the nominal 0.65 volts necessary to keep NPN transistor 10 and PNP transistor 13 on. Thus, about 300 mS after parallel N-channel MOSFETs 15 and 16 were turned on, they turn off and deassert cannon firing output 54. As long as cannon trigger input 50 remains asserted, programmable unijunction transistor 7 will continue being highly conductive from anode to cathode preventing further assertions of cannon firing output 54. Each assertion cycle of cannon trigger input 50 produces one 300 mS assertion of cannon firing output 54. As soon as cannon trigger input 50 is not asserted, capacitor 4 quickly discharges through resistor 6, programmable unijunction transistor 7, and diode 31 preparing the circuit for further use. Even when the voltage across capacitor 4 is too small to keep programmable unijunction transistor 7 or diode 31 conducting, a discharge path exists through resistor 6, resistor 8, resistor 9, and resistor 5.

If cannon arming input 52 is not asserted, PNP transistor 33 will effectively clamp the voltage on junction 21 to a maximum of somewhat more than about 1.5 volts and this will prevent the assertion of cannon firing output 54. If the voltage on junction 21 is less than about 1.5 volts, insufficient voltage exists across the branch from junction 21 across diode 32, the emitter-base junction of PNP transistor 33, and resistor 34 to turn on the two junctions therein. If the voltage on junction 21 is somewhat larger than about 1.5 volts, sufficient voltage exists to turn on the two junctions in the above described branch and PNP transistor 33 will turn on. Voltage significantly above 1.5 volts on junction 21 are not possible because the voltage on junction 21 is determined, while cannon arming input 52 is not asserted, by a forward conducting diode 32 in series with a turned on PNP transistor 33. With junction 21 (gate of programmable unijunction transistor 7) clamped to no more than about 1.5 volts, if cannon trigger input 50 is asserted then junction 22 (anode of programmable unijunction transistor 7) tries to go to about 3.2 volts (as explained above) causing programmable unijunction transistor 7 to become highly conductive. A highly conductive programmable unijunction transistor 7 will prevent NPN transistor 10 from turning on and, in turn, will prevent parallel N-channel MOSFETs 15 and 16 from turning on and asserting cannon firing output 54. In other words, with cannon arming input 52 not asserted, programmable unijunction transistor 7 is set to fire as soon as cannon trigger input 50 is asserted, thus preventing cannon firing output 54 from being asserted.

It is noted that the operation of the circuit is insensitive to large changes in the size of resistor 2, resistor 9, resistor 11, resistor 12, resistor 34. Additionally, it is noted that if resistor 6 and resistor 8 have similar temperature coefficients then the voltage at junction 22 will be insensitive to changes in those resistors. It is further noted that if the characteristic voltage drop across zener diode 3 changes for any reason, such as because of a change in temperature, the inital voltages at junction 21 and junction 22 also change in the same direction and thus the period of the timer changes only slightly because of such a change.

In the preferred embodiment, several components are used to protect the circuit. Diodes 55, 56, 57, and 58 provide protection from a reversal of the supply voltage. The parallel combinations of zener diode 17 and resistor 18, and zener diode 48 and resistor 49 protect the MOSFETs from excessive voltage. Varistor 59 protects the entire circuit from excessive voltage.

The preferred component values are listed in Table 1.

Figure 2:
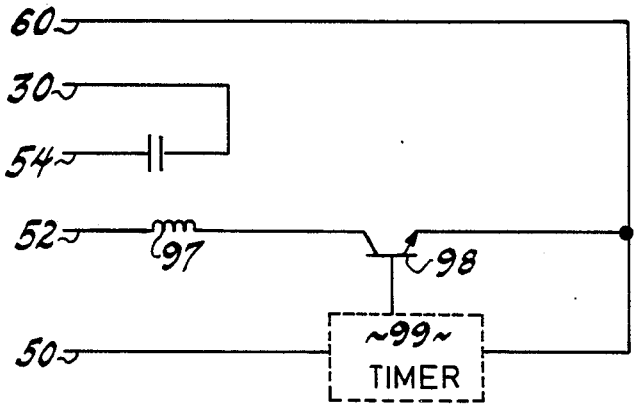
FIG. 2 is an electronic schematic of an alternative embodiment of the invention using electric relays.

An alternative embodiment is shown schematically on FIG. 2. In this embodiment, a relay and switching transistor replace the MOSFETs and voltage boosting circuit of the preferred embodiment. NO relay contacts 96 are placed in series with supply voltage input 30 and cannon firing output 54 so that the latter will be asserted when the relay is asserted. Relay coil 97 is placed in series with cannon arming input 52 and switching transistor 98. If cannon arming input 52 is not asserted then the relay can not be asserted. The base of switching transistor 98 is connected to the output of timer 99 such that switching transistor 98 is turned on when timer 99 asserts. Timer 99 is as described above.

Further embodiments of the invention may be effected by the use of transistors, in lieu of the MOSFETs of the preferred embodiment, with appropriate modifications to the driving circuits used.

Although a preferred embodiment of the invention has been disclosed in detail, it will be recognized that variations or modifications lie within the scope of the present invention.

TABLE 1

| Reference Number | Component |
|---|---|
| 2 | 1 kΩ RN65D resistor |
| 3 | 1N4738A 8.2 v, 1 w zener diode |
| 4 | 15 μF, 20 v, tantalum 10% |
| 5 | 24 kΩ RN55D resistor |
| 6 | 2 kΩ RN55D resistor |
| 7 | 2N6027 PUT |
| 8 | 1 kΩ RN55D resistor |
| 9 | 1 kΩ RN55D resistor |
| 10 | 2N5550 NPN transistor |
| 11 | 47 kΩ RN55D resistor |
| 12 | 2 kΩ RN55D resistor |
| 13 | 2N5401 PNP transistor |
| 14 | 1 kΩ RN55D resistor |
| 15 | 2N6764 MOSFET |
| 16 | 2N6764 MOSFET |
| 17 | 1N5245A, 15 v, ½ w zener diode |
| 18 | 10 kΩ RN55D resistor |
| 31 | 1N914B diode |
| 32 | 1N914B diode |
| 33 | 2N5401 PNP transistor |
| 34 | 1 kΩ RN55D resistor |
| 38 | 2N5401 PNP transistor |
| 39 | 2 kΩ RN55D resistor |
| 41 | 47 kΩ RN55D resistor |
| 42 | 2N5550 NPN transistor |
| 43 | 5.1 kΩ RN55D resistor |
| 45 | 1 kΩ RN55D resistor |
| 46 | 1 kΩ RN55D resistor |
| 47 | 2N6764 MOSFET |
| 48 | 1N5245A, 15 v, ½ w zener diode |
| 49 | 10 kΩ RN55D resistor |
| 55 | Part OF MDA 2501 diode bridge |
| 56 | " |
| 57 | " |
| 58 | " |
| 59 | V36ZA80 |
| 80 | 6.8 μF, 20 v, tantalum capacitor |
| 81 | 1N4744A 15 v, 1 w, zener diode |
| 82 | 1 kΩ RN55D resistor |
| 83 | 470 Ω RN60D resistor |
| 84 | 0.1 μF, 25 v, ceramic capacitor |
| 85 | LM555 |
| 86 | 0.01 μF, 25 v, ceramic capacitor |
| 87 | 270 Ω, 1½ w resistor |
| 88 | 470 Ω RN60D resistor |
| 89 | 330 Ω, 3 w resistor |
| 90 | 2N5550 NPN transistor |
| 91 | 100 Ω RN65D resistor |
| 92 | 1 μF, 100 v ceramic capacitor |
| 93 | 1N4934 diode |
| 94 | 1N4934 diode |
| 95 | 6.8 μF, 100 v aluminum capacitor |

I claim:

1. An electronic circuit for coupling an electrical power supply to a gun firing output for one predetermined time interval upon assertion of a gun triggering input if, and only if, a gun arming input is electrically asserted, comprising:

an electrically actuated switch having a switching input, said electrically actuated switch to couple the electrical power supply to the gun firing output upon receipt of a switching signal upon said switching input;

a timer circuit having an input connected to the gun triggering input and an output connected to said switching input of said electrically actuated switch, for transmitting said switching signal to said switching input of said electrically actuated switch for the predetermined time interval upon assertion of the gun triggering input, said timer circuit including a voltage regulator having an input connected between the gun triggering input and an electrical common, and an output, a series resistor capacitor network, including a resistor, a capacitor and a node therebetween, connected between said output of said voltage regulator and electrical common, an attachment junction, an additional resistor connected beween said output of said voltage regulator and said attachment junction, a three terminal thyristor having a gate connected to said node between said resistor and said capacitor of said series network, and an anode and cathode connected between said attachment junction and said electrical common, and means for transferring signals from said attachment junction to said output of said timer circuit; and means for preventing the transmitting of said switching signal to said switching input of said electrically actuated switch unless the gun arming input is electrically asserted.

2. An electronic circuit as recited in claim 1, wherein said voltage regulator comprises:

a resistor connected between said input and said output of said voltage regulator; and a zener diode connected between said output of said voltage regulator and said electrical common.

3. An electrical circuit as recited in claim 1, wherein said thyristor comprises a programmable unijunction transistor.

4. An electronic circuit as recited in claim 1, wherein said means for transferring signals comprises a further resistor connected between said attachment junction and said output of said timer circuit.

5. An electronic circuit as recited in claim 1, wherein said means for transferring signals comprises:

a transistor amplifier having a base connected through a further resistor to said attachment junction, an emitter connected to electrical common, and a collector being said output of said timer circuit.

6. An electronic thermostat for coupling an electrical power supply to a gun firing output for one predetermined time interval upon assertion of a gun triggering input if, and only if, a gun arming input is electrically asserted, comprising:

an electrically actuated switch having a switching input, said electrically actuated switch to couple the electrical power supply to the gun firing output upon receipt of a switching signal upon said switching input, said electrically actuated switch comprising an electrical relay;

a timer circuit having an input connected to the gun triggering input and an output connected to said switching input of said electrically actuated switch, for transmitting said switching signal to said switching input of said electrically actuated switch for the predetermined time interval upon assertion of the gun triggering input; and means for preventing the transmitting of said switching signal to said switching input of said electrically actuated switch unless the gun arming input is electrically asserted, said means comprising the use of the gun arming input as the power source for turning on said electrical relay.

7. An electronic circuit for coupling an electrical power supply to a gun firing output for one predetermined time interval upon assertion of a gun triggering input if, and only if, a gun arming input is electrically asserted, comprising:

an electrically actuated switch having a switching input, said electrically actuated switch to couple the electrical power supply to the gun firing output upon receipt of a switching signal upon said switching input;

a timer circuit having an input connected to the gun triggering input and an output connected to said switching input of said electrically actuated switch, for transmitting said switching signal to said switching input of said electrically actuated switch for the predetermined time interval upon assertion of the gun triggering input, said timer circuit including a voltage regulator having an input connected between the gun triggering input and an electrical common, and an output, a series resistor capacitor network, including a resistor, a capacitor and a node therebetween, connected between said output of said voltage regulator and electrical common, an attachment junction, an additional resistor connected between said output of said voltage regulator and said attachment junction, a three terminal thyristor having a gate connected to the node between said resistor and said capacitor of said series network, and an anode and cathode connected between said attachment junction and said electrical common, and means for transferring signals from said attachment junction to said output of said timer circuit; and an inhibition circuit connected to the gun arming input and said timer circuit for inhibiting the transmitting of said switching signal by said timer circuit unless the gun arming input is asserted.

8. An electronic circuit as recited in claim 7, wherein said inhibition circuit comprises:

a further electrically actuated switch having a switching input, said further electrically actuated switch to couple said electrical common to said node between said resistor and said capacitor of said series resistor capacitor network upon receipt of a switching signal upon said switching input; and inversion means for coupling the gun arming input to said switching input of said further electrically actuated switch, said inversion means to transmit said switching signal to said switching input of said further electrically actuated switch if, and only if, the gun arming input is not asserted.

9. An electronic circuit as recited in claim 8, wherein said further electrically actuated switch and said inversion means comprises a transistor having an emitter coupled to said node between said resistor and said capacitor of said series resistor capacity network, a collector coupled to said electrical common, and a base coupled to the gun arming input.

10. An electronic circuit as recited in claim 7, wherein said voltage regulator comprises:

a resistor connected between said input and said output of said voltage regulator; and a zener diode connected between said output of said voltage regulator and said electrical common.

11. An electrical circuit as recited in claim 7, wherein said thyristor comprises a programmable unijunction transistor.

12. An electronic circuit as recited in claim 7, wherein said means for transferring signals comprises a further resistor connected between said attachment junction and said output of said timer circuit.

13. An electronic circuit as recited in claim 7, wherein said means for transferring signals comprises;

a transistor amplifier having its base connected through a further resistor to said attachment junction, its emitter connected to said electrical common, and its collector being said output of said timer circuit.

14. An electronic circuit for coupling an electrical power supply to a gun firing output for one predetermined time interval upon assertion of a gun triggering input if, and only if, a gun arming input is electrically asserted, comprising:

a MOSFET switch having a gate, a source and a drain, said source and drain connected to couple the electrical power supply to the gun firing output upon receipt of a switching signal upon said gate;

a timer circuit having an input connected to the gun triggering input and an output connected to said gate of said MOSFET switch, for transmitting said switching signal to said gate of said MOSFET switch for the predetermined time interval upon assertion of the gun triggering input; and means for preventing the transmission of said switching signal to said gate of said MOSFET switch unless the gun arming input is electrically asserted.

15. An electronic circuit as recited in claim 14, further comprising:

a voltage boosting circuit connected to said timing circuit including an oscillator with an output signal large enough to switch on and off a transistor, a switching transistor having a base connected to the output of said oscillator, an emitter connected to electrical common, and a collector, a first resistor having a first end connected to the supply voltage and a second end connected to said collector of said switching transistor, a first series network including a second resistor and a first capacitor connected in series having a first end connected to said collector of said switching transistor and a second end, a first diode having an anode connected to said supply voltage and a cathode connected to said second end of said first series network, a second diode having an anode connected to said second end of said first series network and a cathode forming a boosted voltage output, and a second capacitor having a first end connected to said cathode of said second diode and a second end connected to said electrical common; and wherein said timing circuit transmits said switching signal by connecting said boosted voltage output to said base of said MOSFET.

16. An electronic circuit for coupling an electrical power supply to a gun firing output for one predetermined time interval upon assertion of a gun triggering input if, and only if, a gun arming input is electrically asserted, comprising:

a MOSFET switch having a gate, a source and a drain, said source and drain connected to couple the electrical power supply to the gun firing output upon receipt of a switching signal upon said gate;

a timer circuit having an input connected to the gun triggering input and an output connected to said gate of said MOSFET switch, for transmitting said switching signal to said gate of said MOSFET switch for the predetermined time interval upon assertion of the gun triggering input; and an inhibition circuit connected to the gun arming input and said timer circuit for inhibiting the transmitting of said switching signal by said timer circuit unless the gun arming input is asserted.

17. An electronic circuit as recited in claim 16, further comprising:

a voltage boosting circuit connected to said timing circuit including an oscillator with an output signal large enough to switch on and off a transistor, a switching transistor having a base connected to the output of said oscillator, an emitter connected to electrical common, and a collector, a first resistor having a first end connected to the supply voltage and a second end connected to said collector of said switching transistor, a first series network including a second resistor and a first capacitor connected in series having a first end connected to said collector of said switching transistor and a second end, a first diode having an anode connected to said supply voltage and a cathode connected to said second end of said first series network, a second diode having an anode connected to said second end of said first series network and a cathode forming a boosted voltage output, and a second capacitor having a first end connected to said cathode of said second diode and a second end connected to said electrical common; and wherein said timing circuit transmits said switching signal by connecting said boosted voltage output to said base of said MOSFET.

* * * * *